US010089816B2

(12) United States Patent
Pagano et al.

(10) Patent No.: US 10,089,816 B2
(45) Date of Patent: Oct. 2, 2018

(54) SIDE BETTING IN BLACKJACK GAME

(71) Applicant: Zynga Inc., San Francisco, CA (US)

(72) Inventors: Michael Pagano, San Francisco, CA (US); Hal Hanlin, Austin, TX (US)

(73) Assignee: Zynga Inc., San Francisco, CA (US)

( * ) Notice: Subject to any disclaimer, the term of this patent is extended or adjusted under 35 U.S.C. 154(b) by 690 days.

(21) Appl. No.: 14/270,592

(22) Filed: May 6, 2014

(65) Prior Publication Data

US 2015/0325087 A1 Nov. 12, 2015

(51) Int. Cl.
*G07F 17/32* (2006.01)

(52) U.S. Cl.
CPC ..... *G07F 17/32* (2013.01); *G07F 17/3209* (2013.01); *G07F 17/3225* (2013.01); *G07F 17/3293* (2013.01)

(58) Field of Classification Search
None
See application file for complete search history.

(56) References Cited

U.S. PATENT DOCUMENTS

| | | | | |
|---|---|---|---|---|
| 5,636,843 | A * | 6/1997 | Roberts | A63F 1/18 273/292 |
| 5,755,621 | A | 5/1998 | Marks et al. | 463/42 |
| 5,833,540 | A | 11/1998 | Miodunski et al. | 463/42 |
| 5,971,849 | A | 10/1999 | Falciglia | 463/16 |
| 6,039,648 | A | 3/2000 | Guinn et al. | 463/16 |
| 6,077,162 | A | 6/2000 | Weiss | 463/26 |
| 6,158,741 | A * | 12/2000 | Koelling | A63F 3/00157 273/292 |
| 6,450,500 | B1 | 9/2002 | Miller | 273/292 |
| 7,066,465 | B2 | 6/2006 | Daines | 273/292 |
| 7,255,351 | B2 | 8/2007 | Yoseloff et al. | 273/274 |
| 8,459,650 | B2 | 6/2013 | Baseel | 273/292 |
| 8,727,850 | B2 | 5/2014 | Burnside et al. | 463/13 |
| 2002/0045474 | A1 | 4/2002 | Singer et al. | 463/20 |
| 2003/0222400 | A1 | 12/2003 | Collins et al. | 273/274 |
| 2005/0054446 | A1 | 3/2005 | Kammier et al. | 463/42 |
| 2005/0253338 | A1 | 11/2005 | Daines | 273/292 |
| 2006/0035700 | A1* | 2/2006 | Van Asdale | G07F 17/32 463/19 |
| 2006/0205461 | A1* | 9/2006 | LaRocca | G07F 17/32 463/1 |
| 2012/0074647 | A1* | 3/2012 | Hall | G07F 17/3293 273/274 |
| 2016/0358424 | A1* | 12/2016 | Thomas | G07F 17/3209 |

* cited by examiner

*Primary Examiner* — Robert T Clarke, Jr.
(74) *Attorney, Agent, or Firm* — Martine Penilla Group, LLP

(57) ABSTRACT

Methods, systems, and computer programs are provided for providing players with additional side betting options. One method includes operations for receiving user account information of a first player for playing a blackjack game, and for providing data for a sideboard interface to be presented before a round of the blackjack game. The sideboard interface provides options for side bets, which are wagers on cards dealt during the round. Additionally, the method includes an operation for providing data for a blackjack interface for playing the blackjack game after side bets have been entered. A check is made to determine if the one or more cards dealt during the round of the blackjack game produce one or more winning side bets, and a currency counter of the user account is increased of the first player for the one or more winning side bets during the round of the blackjack game.

18 Claims, 9 Drawing Sheets

SIDE BETTING IN BLACKJACK GAME

BACKGROUND

1. Field of the Invention

The present embodiments relate to methods for providing an online game, and more particularly, methods, systems, and computer programs for providing players with additional betting options.

2. Description of the Related Art

Online betting games have become very popular, including casino-style games, such as video slots, online poker, video poker, blackjack, etc. In order to make games more interesting, game providers try to offer alternatives within the game to increase their variability, challenges, and bonus games.

However, many of the online games simply simulate game experience of a player played in a casino, which makes these online games similar with little differentiation from each other, resulting in a lack of customer loyalty.

Increasing the options available to a player in the game improves customer experience, which results in longer playing periods of engagement. Also, by improving customer experience, game providers may entice new players to play the game. Further, by providing additional game options, players may increase their bet amounts which may result in increasing purchases of game currency.

Game options are desired that improve customer satisfaction with the game. It is in this context that embodiments arise.

SUMMARY

Methods, devices, systems, and computer programs are presented for providing players with additional side betting options. It should be appreciated that the present embodiments can be implemented in numerous ways, such as a method, an apparatus, a system, a device, or a computer program on a computer readable medium. Several embodiments are described below.

In one embodiment, a method includes an operation receiving from a first device user account information of a first player for playing a blackjack game. Additionally, the method includes an operation for providing first data for a sideboard interface to be presented by the first device before a round of the blackjack game. The sideboard interface presents options for side bets, the side bets being wagers on one or more cards dealt during the round of the blackjack game. The side bets do not include wagers for the blackjack game. Further, the method includes an operation for providing second data for a blackjack interface to be presented by the first device for playing the blackjack game after one or more side bets have been entered by the first player in the sideboard interface. In addition, the method includes operations for checking if the one or more cards dealt during the round of the blackjack game produce one or more winning side bets, and for increasing a currency counter of the user account of the first player for the one or more winning side bets during the round of the blackjack game. In one embodiment, the operations of the method are executed by a processor.

In another embodiment, a method includes an operation for receiving, from a first device, user account information of a first player for playing a blackjack game. In addition, the method includes an operation for providing first data for a sideboard interface to be presented by the first device before a round of the blackjack game. The sideboard interface presents options for side bets, each side bet being a wager that a selected card denomination of a selected suit is dealt during the round of the blackjack game to any player or to a dealer. The sideboard interface includes a matrix by card denomination and by suit for selecting each side bet. Further, the method includes an operation for providing second data for a blackjack interface to be presented by the first device for playing the blackjack game after one or more side bets have been entered by the first player in the sideboard interface. Additionally, the method includes operations for checking if the one or more cards dealt during the round of the blackjack game produce one or more winning side bets, and for increasing a currency counter of the user account of the first player for the one or more winning side bets during the round of the blackjack game. In one embodiment, the operations of the method are executed by a processor.

In yet another embodiment, a non-transitory computer-readable storage medium stores a computer program, the computer-readable storage medium including program instructions for receiving from a first device user account information of a first player for playing a blackjack game, and program instructions for providing first data for a sideboard interface to be presented by the first device before a round of the blackjack game. The sideboard interface presents options for side bets, the side bets being wagers on one or more cards dealt during the round of the blackjack game. The side bets do not include wagers for the blackjack game. Additionally, the storage medium further includes program instructions for providing second data for a blackjack interface to be presented by the first device for playing the blackjack game after one or more side bets have been entered by the first player in the sideboard interface, and program instructions for checking if the one or more cards dealt during the round of the blackjack game produce one or more winning side bets. The storage medium further includes program instructions for increasing a currency counter of the user account of the first player for the one or more winning side bets during the round of the blackjack game.

Other aspects will become apparent from the following detailed description, taken in conjunction with the accompanying drawings.

BRIEF DESCRIPTION OF THE DRAWINGS

The embodiments may best be understood by reference to the following description taken in conjunction with the accompanying drawings.

DETAILED DESCRIPTION

The following embodiments describe methods, devices, systems, and computer programs for providing players with additional betting options. It will be apparent, that the present embodiments may be practiced without some or all of these specific details. In other instances, well-known process operations have not been described in detail in order not to unnecessarily obscure the present embodiments.

Embodiments presented herein enable blackjack players to place bets that are not part of the blackjack game itself. These types of bets are referred to herein as side bets, and in one embodiment, a separate side-betting interface for entering side bets is presented to the user. With side bets, players bet on the cards that will be dealt during the game of blackjack.

Figure 1:
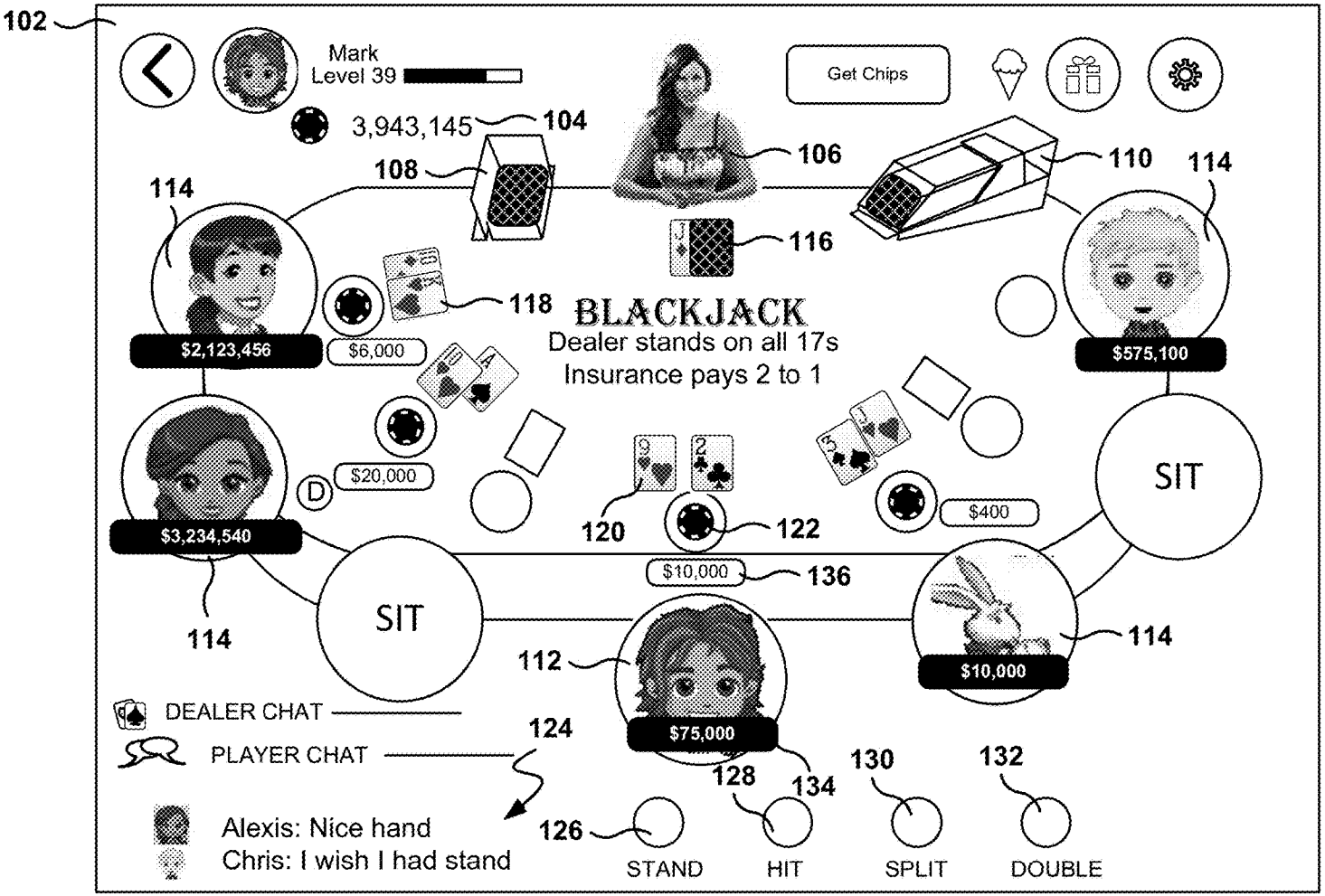
FIG. 1 depicts an interface for playing a blackjack game, according to one embodiment.

FIG. 1 depicts an interface 102 for playing a blackjack game, according to one embodiment. Before the cards are dealt, each player places a bet 122, and the amount of the bet is displayed in box 136. During the game of blackjack, a dealer 106 deals cards (120 and 118) from a card shoe 110 to the players 114, 112 sitting at the table.

Initially, each player and the dealer gets two cards, with the dealer showing one card face up and another card face down. The goal of the game is to get as close as possible to 21 without going over. Figure cards are worth 10 points, number cards are worth their respective number, and the ace is worth 1 or 11, whichever makes a better hand. When it's the player's turn to play, the player may stand 126 to keep the current hand or hit 128 to get an additional card in order to improve the player's hand. If the player goes over 21, the player loses the bet. After all the players finish their hands by standing or going over 21, the dealer plays her hand aiming to get 17 or better, by dealing additional cards, if necessary, or until the dealer goes over.

As used herein, a round of blackjack includes all the plays entered by players to compete against one hand of the dealer. Therefore, the round of blackjack includes all the cards dealt to players while competing against the one hand of the dealer and the cards dealt to the dealer for that one hand.

Currency counter 104 indicates how much game currency (e.g., chips, coins, real money, virtual money, etc.) the user has in the user's account. The currency counter 104 is also referred to as the player's bank. For description purposes, the game currency is described herein as units, which may represent virtual currency or real-money currency, or any combination thereof. In one embodiment, a second currency 106 is also provided. The second currency may be used to buy other game related items, such as more chips, shortcuts in the game, game hints, etc.

Additionally, the player selects how much money to set on the table when the player "sits" at the blackjack table (see table counter 134). As the player wins or loses money, currency counter 104 and table counter 134 are updated.

During play, the player may sometimes split 130 a hand, or double up 132, although these options are not always available and depend on the cards in the hand of the player. If the player goes over 21, the player's cards are placed in the discard pile 108. In addition, at the end of the hand all the cards from the players that did not go over and the dealer are placed in discard pile 108. A chat box 124 allows players to chat with each other.

Embodiments are presented herein with reference to a game of blackjack, but the same or similar principles apply to other kinds of video games or card games, such as video poker or slots. Further, the same principles may be applied to any game that is based on chance, either from cards, dice, roulette, spinning wheel, slots, etc.

The embodiments presented may be applied to real-life money gambling only when their implementation, all or in part, follow the pertinent rules and regulations for real-money gambling. Further, in one embodiment, the game includes a random number generator, and for real-money gambling, the random number generator follows the prescribed rules and regulations. In addition, for real-money gambling, certain features may be adjusted or modified to follow the prescribed rules and regulations.

It is noted that the embodiments presented herein may be implemented in any computing platform having a display. For example, the game may be played on a personal computer, a tablet, a smart phone, a mobile device, a slots machine, etc. In addition, the inputs for playing the game may be entered via keyboard, buttons, mouse, touchscreen touches, gestures, voice, etc. In addition, the embodiments presented herein may also be utilized for real-life games.

Figure 2:
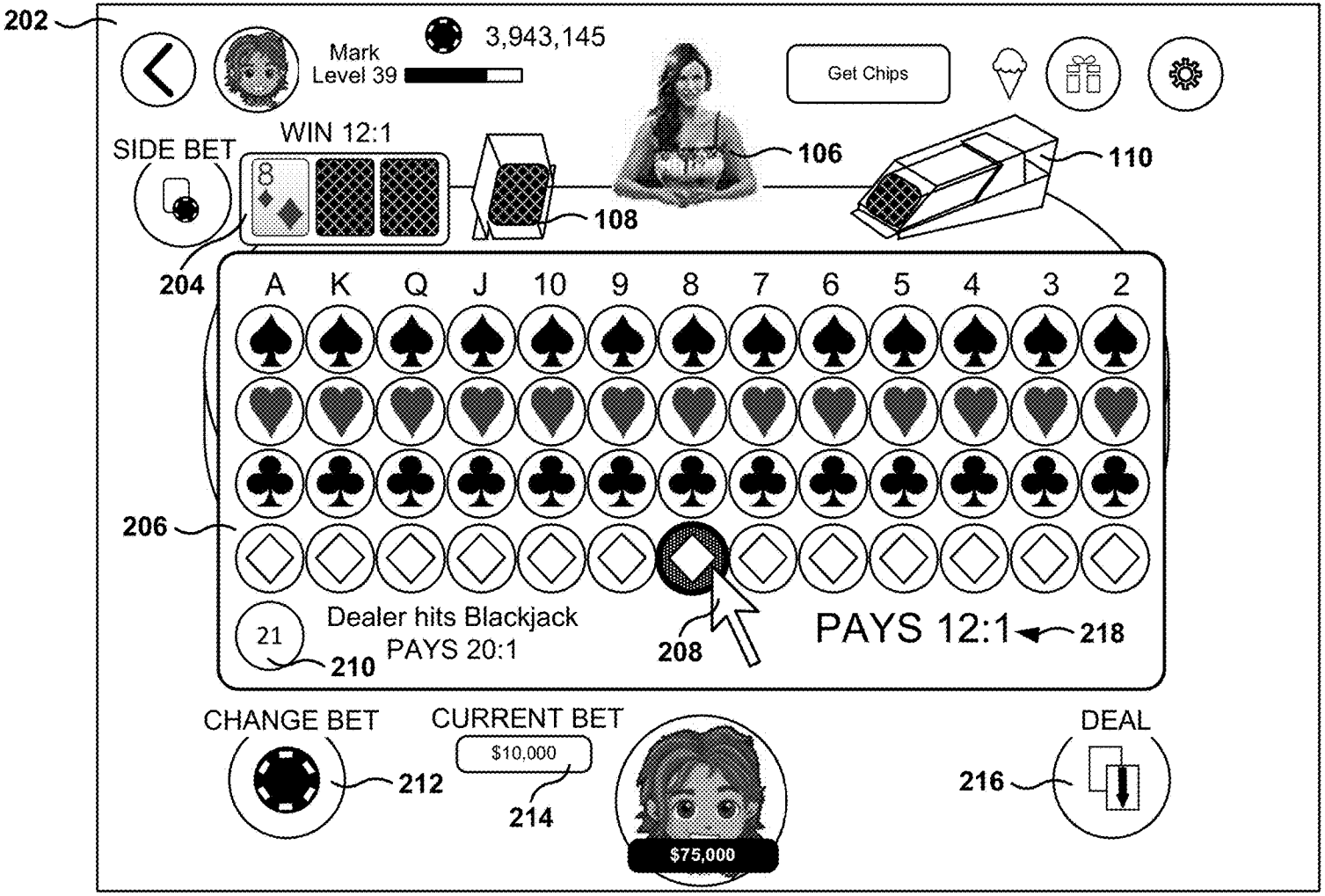
FIG. 2 illustrates an interface for entering side bets, according to one embodiment.

FIG. 2 illustrates an interface 202 for entering side bets, according to one embodiment. Side bet interface 202 is presented to users before the round of blackjack starts, and the side bet interface 202 provides options for betting on the cards that will be dealt during the round of blackjack. The side bet interface 202 is also referred to herein as a side board. In another embodiment, the side bet interface 202 may also be presented as an option to the player during the blackjack game.

The bets entered via the side bet interface are referred to herein as side bets. Regular bets are referred to herein as those bets entered for the game of blackjack, as previously described with reference to FIG. 1. One of the differences between a regular bet and a side bet is that a player wins a regular bet when the player hand beats the dealer hand, but the side bet is not won just because the player hand beats the dealer hand.

For example, a player may think that she hasn't seen any queens in the current deck, or that she has seen just a few queens. The player may then bet on queens coming out during the round of blackjack and make money when the queens appear.

In one embodiment, side bet interface 202 includes a bet entry area 206, which includes a matrix of all the cards in the deck where the rows are the different suits and the columns correspond to the different card denominations. To bet on a specific card, the player selects 208 the card in the matrix. In one embodiment, if the selected card appears during the game of blackjack, the player is paid 12:1. If the player selects the card a second time, the bet is canceled for that card.

In one embodiment, the player may bet on three cards, and as the player makes each side bet for a card, the car is presented in card-bet area 204. In one embodiment, besides betting on specific cards, the player may bet on the dealer getting a blackjack 210, which pays 20:1.

Side bet interface 202 displays the shoe 110 with the remaining cards to be dealt in the blackjack game, and discard pile 108. The size of the pile of cards in the shoe 110 and the number of cards in the discard pile 108 provide a visual hint to the player on how many cars have already been dealt and how many are left. This may become handy when the player becomes confident that a certain card has not shown up and the discard pile 108 is rather large.

In one embodiment, if the dealer is going to shuffle the deck or decks before playing the round of the blackjack game, the shoe 110 will be full and the discard pile will be empty or holding just a few discard cards.

Option 212 allows the player to change the amount for the side bet and option 216 may be selected by the player to return to the blackjack game and start dealing cards. In one embodiment, if the player clicks or selects any area that is not associated with a side bet, side betting is terminated and the game resumes to the blackjack interface.

One of the advantages of the side board is that the side board allows players to obtain big wins. Typically, during a game of blackjack the player is able to win the amount bet, or sometimes even double the amount bet, but a side bet may provide larger one-time wins paying 12:1 or 20:1. Further, when playing with multiple decks, the same card may appear more than once, which may result in even larger winnings.

The side board encourages player to count cards, i.e., keeping track of the cards that have already been dealt. Since this is a skill that may help the blackjack player, the side board is a training tool for blackjack players.

Additionally, the side bets may give the player a sense of control, because the player may hedge a bet against her own hand, because even if the player loses a blackjack hand, the player may come out a winner with a side bet.

In one embodiment, observers or spectators (e.g., players that are not sitting at the blackjack table) may also bet in the side board, which increases participation by others and social interaction. For example, friends of the player may bet on the side board while the player is playing the blackjack game.

It is noted, that the player gets paid only for side bets that the player makes, and not paid by side bets entered by other players. However, in one embodiment, to win a side bet, the card may be dealt to any of the players or to the dealer, and not just to the player that made the side bet.

In one embodiment, the cost of each side bet is equal to the bet in the blackjack game, but in other embodiments, the side bet is configurable by the player independent of the bet in the blackjack game. For example, the side bet may be 10%, or 50%, or twice the cost of the regular blackjack bet, etc. Embodiments may be implemented using any type of cost structure for the side bet.

It is noted that, in one embodiment, the side bet is a bet independent of the regular bet for the blackjack game (e.g., bet 122 of FIG. 1), and as used herein, a side bet does not include the regular bet for the blackjack game. The price paid for the side bet does not change the regular blackjack game bet.

It is noted that the embodiments illustrated in FIG. 2 are exemplary. Other embodiments may utilize different side bets, different ways of entering side bets, different side bet combinations, etc. The embodiments illustrated in FIG. 2 should therefore not be interpreted to be exclusive or limiting, but rather exemplary or illustrative.

Figure 3:
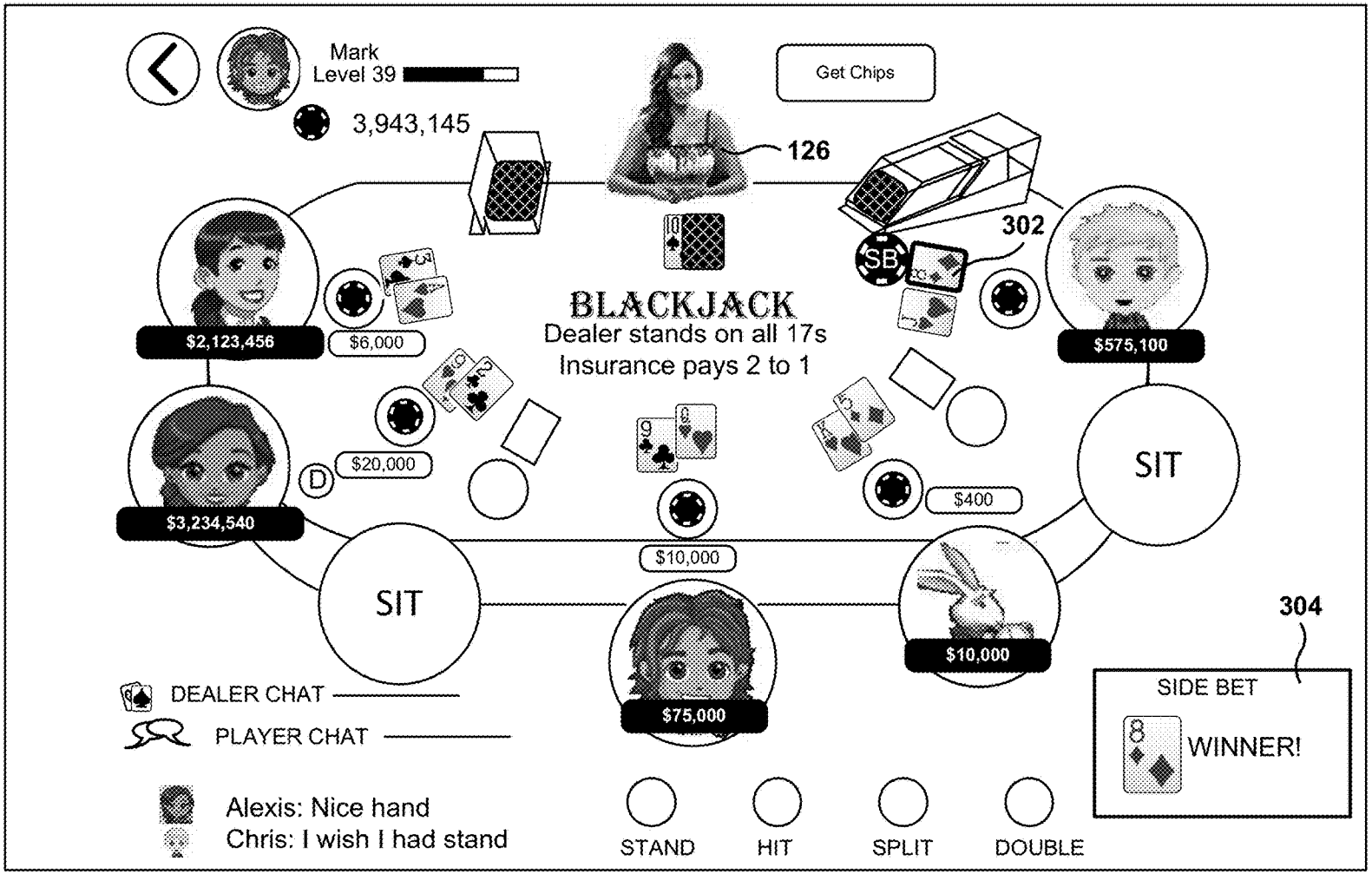
FIG. 3 illustrates winning a side bet while playing the blackjack game, according to one embodiment.

FIG. 3 illustrates winning a side bet while playing the blackjack game, according to one embodiment. Once the dealing of the blackjack card starts, side betting is stopped. In one embodiment, the side bets are presented in side bet message area 304.

In one embodiment, the side board is concealed during the game of blackjack. In another embodiment, an option is provided to the player for opening the side board during the blackjack game (e.g., selecting or clicking on side bet message area 304).

When a side-bet card is dealt (also referred to herein as the money card or the gold card), the side-bet card is highlighted (e.g., presented in a different brightness, or a different color, or framed, or with a halo around the card, a sound is played, etc.) and a chip representing the player's winning is placed next to the money card.

It is noted, that the money card may be dealt to any of the players and not just the player that made the side bet. Of course, when the money card hits, the player's bank is credited with the appropriate winnings.

In one embodiment, when the round of blackjack ends, the side board interface is presented again and the player may repeat the bet (e.g., "rebet") or make new bets. In one embodiment, an option is provided to clear all the side bets.

Side betting is integrated into the blackjack game in a way that may change the way a player plays because the player may be incentivized to "see" more cards (e.g., more cards being dealt in the round of blackjack), because every card that comes out on the table gives the player another chance at a fairly large payout. For example, if the player is betting on 3s, and the player has a 17, and the player hasn't seen many threes yet, the player may ask for a card just to have a chance to hit the three.

As previously discussed, the side bets may be won on any of the cards dealt during the round of blackjack. However, in other embodiments, the cards involved in a side bet may be a subset of the cards dealt during the round of blackjack, or may even encompass more than one round. For example, a side bet may be made on the cards dealt to the player or to the cards dealt to the dealer. In another embodiment, the side bet covers a predetermined number of cards dealt (e.g., 7 cards although other values are also possible). This way, the statistical value of a bet may be calculated easier since the number of cards in play is predetermined and does not vary according to the number of players. In one embodiment, the payout for the side bets is adjusted based on the number of players sitting at the table.

In one embodiment, the player may place a side bet on cards that are dealt between two shuffles, that is, cards that are dealt from the same shoe before the cards are shuffled again, or the player may bet all the cards in the shoe that are dealt only to the player.

The game of blackjack may use one deck, or several decks (e.g., 6, 8, etc.) for the shoe. Embodiments presented herein may be practiced with any number of decks for the game of blackjack.

Figure 4:
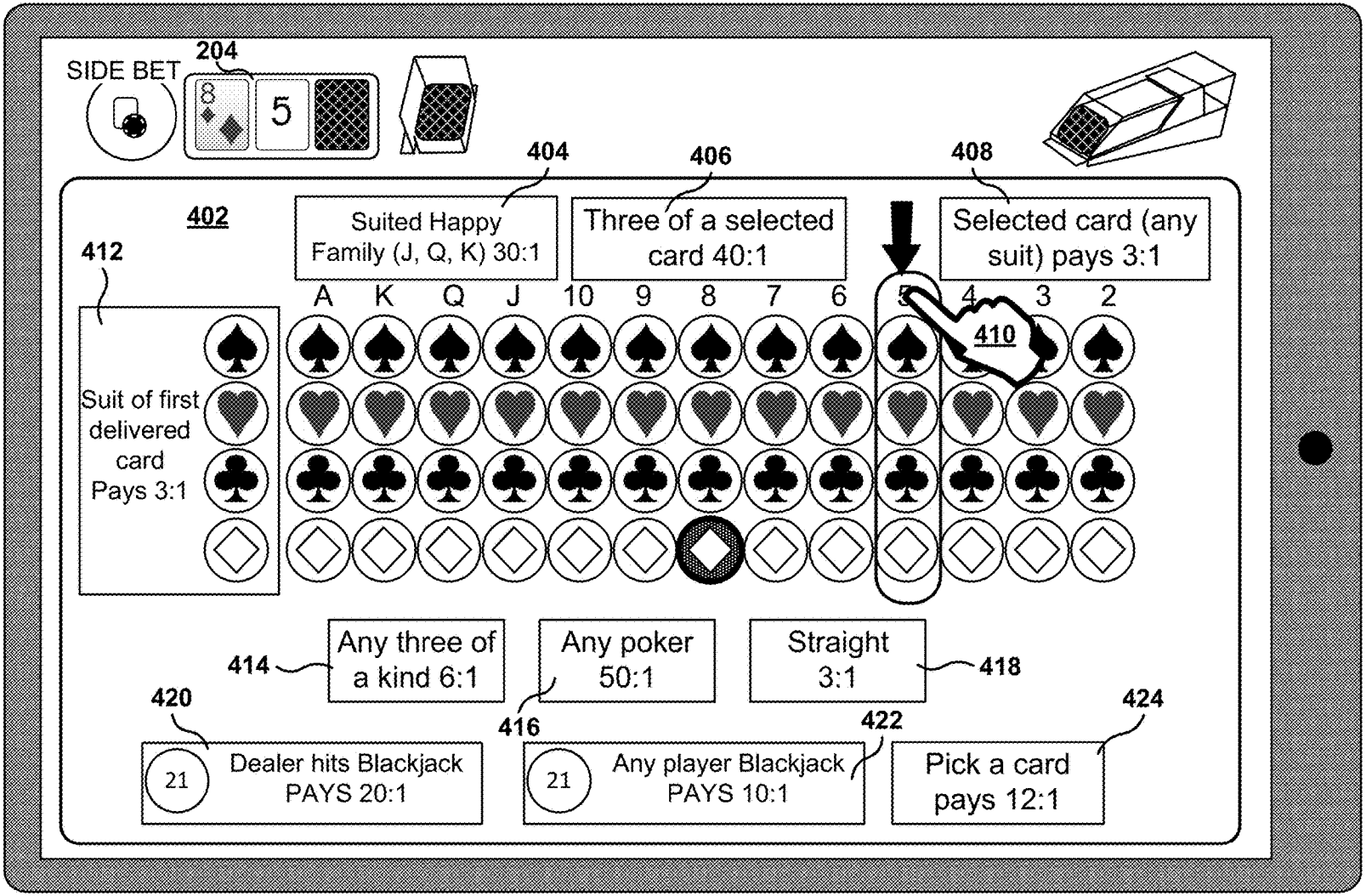
FIG. 4 illustrates a sideboard interface with several side-bet options, according to one embodiment.

FIG. 4 illustrates a sideboard interface with several side-bet options, according to one embodiment. FIG. 4 illustrates a side board displayed on a portable device for a player that is playing blackjack in the portable device.

The sideboard of FIG. 2 includes options for betting on a single card or on a dealer's blackjack. However, other embodiments may include other type of side bets. Besides betting on single cards, players may select bets that include a combination of cards. For example, a player may bet 410 on a 5 coming up 408, therefore, the player would win the side bet if any 5 comes up during the blackjack game, independently of the suit of the 5.

Other types of combinations may be covered by different side bets. The following is a list of other types of side bets:

- a suited happy family, which includes the Jack, Queen, and King of the same suit, and which pays 30:1,
- three of a kind 406 of a selected card denomination (e.g., three sevens) which pays 40:1, the suit of the first card delivered during the round 412, which pays 3:1, three of a kind 414 (of any card denomination), which pays 6:1, any four of a kind (i.e., a poker) 416, which pays 50:1, a straight of five cards (where the straight is defined by the game of poker) 418, which pays 3:1, a dealer blackjack 420, which pays 20:1 any blackjack during the round, which pays 10:1, etc.

Additionally, the number of side bets may be other than 3, e.g., the number of side bets may be in the range of 1 to 10, or in one embodiment, unlimited.

In one embodiment, the pay of the different side bets may be adjusted to accommodate for the potential increases in payout due to side bets. In one embodiment, the payout for some of the bets in the regular blackjack game may also be adjusted to accommodate for the changes introduced by the side bets. For example, in one embodiment, a blackjack may pay only 1:1 instead of 1.5:1.

In one embodiment, side betting is done in real life with real money by using a separate croupier sitting at the blackjack table and managing the side bets, which includes taking side bets from players or spectators and paying for winning side bets. In one embodiment, the separate croupier uses a computing device with a display in order to manage the side bets. Further, in another embodiment, the users sitting at a real blackjack table may also have a separate computing device with a display for entering site bets, and the side betting may be managed by a separate croupier or even by the blackjack dealer assisted by a computing device that indicates when side bets are winners.

Figure 5:
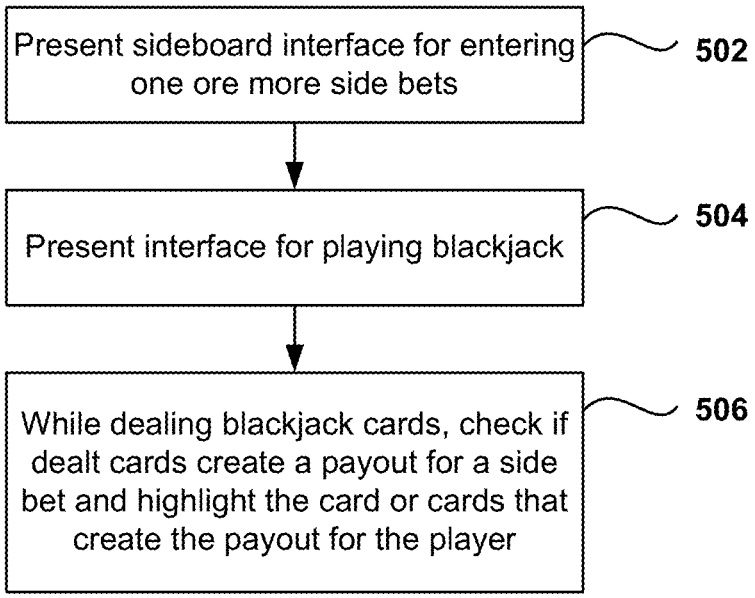
FIG. 5 is a flowchart illustrating an algorithm for playing blackjack with options for side bets, according to one embodiment.

FIG. 5 is a flowchart illustrating an algorithm for playing blackjack with options for side bets, according to one embodiment. While the various operations in this flowchart are presented and described sequentially, one of ordinary skill will appreciate that some or all of the operations may be executed in a different order, be combined or omitted, or be executed in parallel.

In operation 502, a sideboard interface is presented to the player (e.g., interfaces of FIGS. 2 and 4). The sideboard interface provides options for entering one or more side bets.

From operation 502, the method flows to operation 504 where the interface for playing blackjack is presented to the player after finishing entering site bets. From operation 504, the method flows to operation 506 where, while dealing cards for the game of blackjack, checks are made to determine if the dealt cards create a payout for a side bet. In one embodiment, when a card dealt creates a winning side bet, the card is highlighted. Further, when a card dealt is part of a combination for a side bet (e.g., three 7s), the card is highlighted to the player. Although the card has not produced a winning side bet yet, the prominent presentation of the card allows the player to easily track combinations that the player entered for side bets.

In one embodiment, the game of blackjack is part of a virtual casino that includes other blackjack tables and other games of chance (e.g., poker, slots, baccarat, craps, etc.). Players can play with friends by sitting at the same table or wandering around the virtual casino from game to game.

In one embodiment, the casino provides an option to receive notifications when a friend of the player is at a table that is producing "heat," also referred to as a table "on fire." A table on fire is a game table where players have been winning, e.g., beating the house. The faster the players win at the table, the more heated the table becomes.

Additionally, not only tables can be on fire, but also players can be on fire, by beating the house for a predetermined period of time or hands. The more the player wins, the more the player becomes on fire or heats up, but if the player starts losing, then the player stops being on fire.

When a player is on fire, the sideboard interface and the blackjack interface produce animations or images identifying that the player is on fire. Additionally, the player may get additional experience points.

In one embodiment, when a player is on fire, every time the player wins the player gets points (e.g., on-fire points) or additional currency for being on-fire. Additionally, friends of the player that are playing at the same table, or that are watching the player's table, get additional on-fire points or token currency chips. Therefore, when friends are playing together, if a player becomes on fire then the friends benefit too. This encourages social interactions in the blackjack game and in the casino.

Therefore, if the player is on fire for five turns, then the player is helping friends and everybody else at the same table, or even in the same room. In one embodiment, when a player gets on fire, the heat sets the whole table on fire so all the players of the same table get the benefits of being on fire (e.g., getting extra currency or extra experience points).

There can be several ways in which a player gets on fire. For example, a player may be in fire when the player wins three hands in a row, or when the player wins a bet that is bigger than a threshold bet, or when a player wins the last three out of the last four hands, or when a player gets an exceptional good hand (e.g., the player doubles up in a hand of blackjack and wins both bets, a player gets for of a kind or better in poker, etc.).

When a player gets on fire, friends get notified. In one embodiment, the notifications may be sent to friends that are at the casino playing, or a message may be sent to a friend that is not in the casino (e.g., email, text, social network post, etc.). The friends may visit the player's table and participate by entering site bets, because, in one embodiment, players may enter side bets even if the players are not sitting at the blackjack table.

Spectator betting is similar to sports betting (because spectators bet on which card will come up). For example, the spectator hasn't seen any nines, and the spectator can bet on a nine coming up. The spectator is motivated to count cards in order to win bets.

In one embodiment, the spectators may see what side bets other players are entering in order to copy other players. For example, if a player is playing at the blackjack table and a friend knows that the player is good at guessing which card will turn (e.g., by counting cards), then the friend may want to enter the same site bets for herself.

Figure 6:
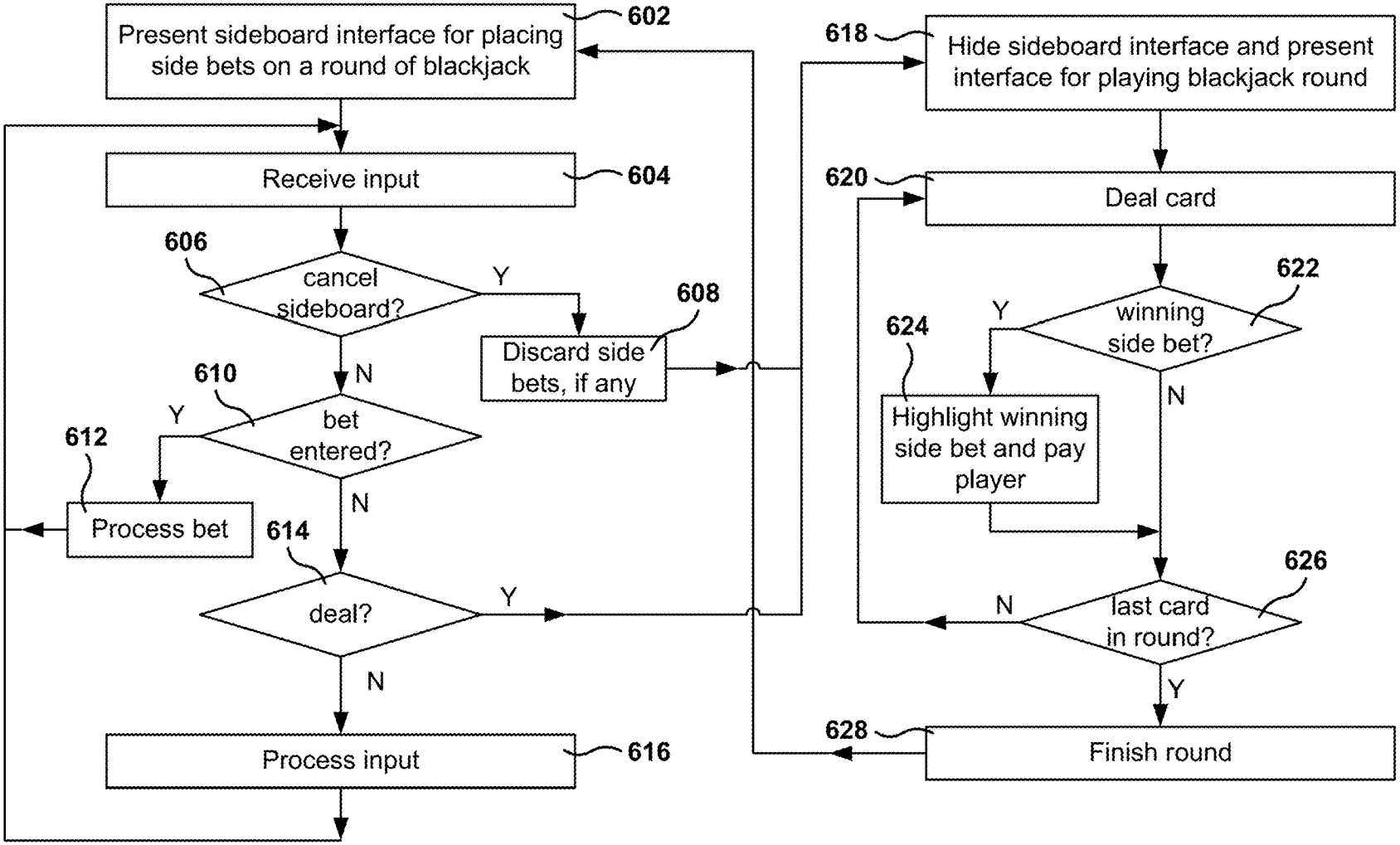
FIG. 6 is a flowchart illustrating a second algorithm for playing blackjack with options for side bets, according to one embodiment.

FIG. 6 is a flowchart illustrating a second algorithm for playing blackjack with options for side bets, according to one embodiment. While the various operations in this flowchart are presented and described sequentially, one of ordinary skill will appreciate that some or all of the operations may be executed in a different order, be combined or omitted, or be executed in parallel.

In operation 602, a sideboard interface is presented. The sideboard interface provides options for placing side bets during a round of blackjack. From operation 602, the method flows to operation 604 where an input from the player is received. In operation 606, a check is made to determine if the input is to cancel the sideboard interface. If the sideboard interface is canceled, the method flows to operation 608 where any side bets already entered, if any, are discarded. If the sidebar is not canceled, the method flows to operation 610 where a check is made to determine if a bet has been entered. If the side bet has been entered, the method flows to operation 612 to process the bet, and if no side bet has been entered, the method flows to operation 614.

From operation 612, the method flows to operation 604. In operation 614, a check is made to determine if an option to start dealing blackjack cards has been entered. If the deal option has been selected, the method flows to operation 618, and if the deal option has not been selected, the method flows to operation 616 to process any other type of input (e.g., an option to buy virtual items, an option to buy currency, etc.). From operation 616, the method flows back to operation 604.

In operation 618, the sideboard interface is hidden and the blackjack interface is presented for playing the round of blackjack. From operation 618, the method flows to operation 620 where a new card is dealt. If the dealt card produces a winning side bet 622, the method flows to operation 624 where the winning side bet is highlighted and the player is paid (e.g., the currency counter of the player's account is incremented).

From operation 622 or operation 624, the method flows to operation 626 where a check is made to determine if the last card dealt was the last card in the round. If it was the last card, the method flows to operation 628 to finish the round of the blackjack game. If it was not the last card, the method flows back to operation 602 to enable the user to enter site bets for the next round.

Figure 7:
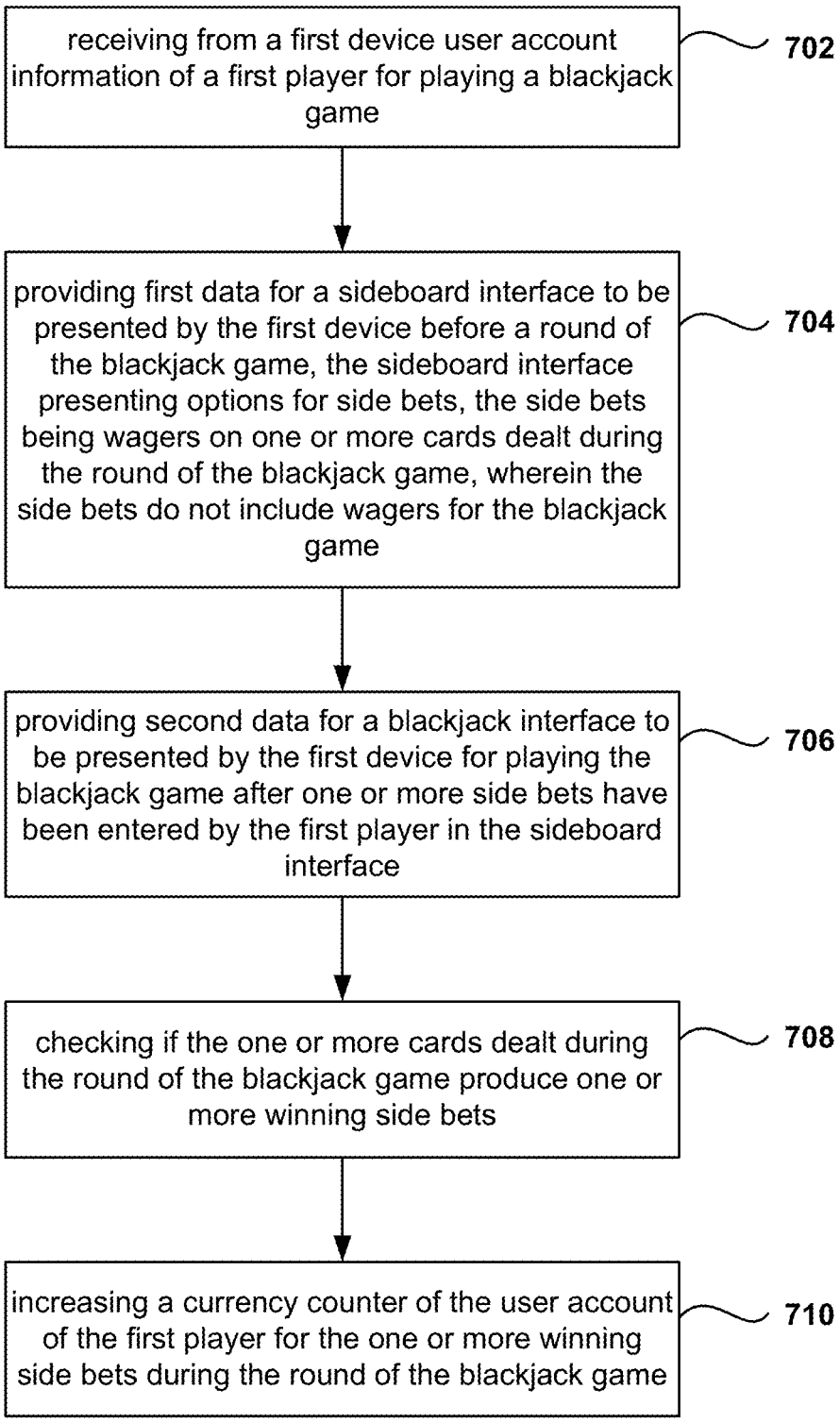
FIG. 7 is a flowchart illustrating an algorithm for providing players with additional side-betting options, according to one embodiment.

FIG. 7 is a flowchart illustrating an algorithm for providing players with additional side-betting options, according to one embodiment. While the various operations in this flowchart are presented and described sequentially, one of ordinary skill will appreciate that some or all of the operations may be executed in a different order, be combined or omitted, or be executed in parallel.

In operation 702, user account information is received from a first device, the user account being associated with a first player for playing a blackjack game.

From operation 702, the method flows to operation 704, for providing first data for a sideboard interface to be presented by the first device before a round of the blackjack game. The sideboard interface presents options for side bets, the side bets being wagers on one or more cards dealt during the round of the blackjack game, where the side bets do not include wagers for the blackjack game (e.g., wagers to beat the dealer hand).

From operation 704, the method flows to operation 706, for providing second data for a blackjack interface to be presented by the first device for playing the blackjack game after one or more side bets have been entered by the first player in the sideboard interface.

From operation 706, the method flows to operation 708, for checking if the one or more cards dealt during the round of the blackjack game produce one or more winning side bets.

From operation 708, the method flows to operation 710, where a currency counter of the user account of the first player is increased for the one or more winning side bets during the round of the blackjack game.

Figure 8:
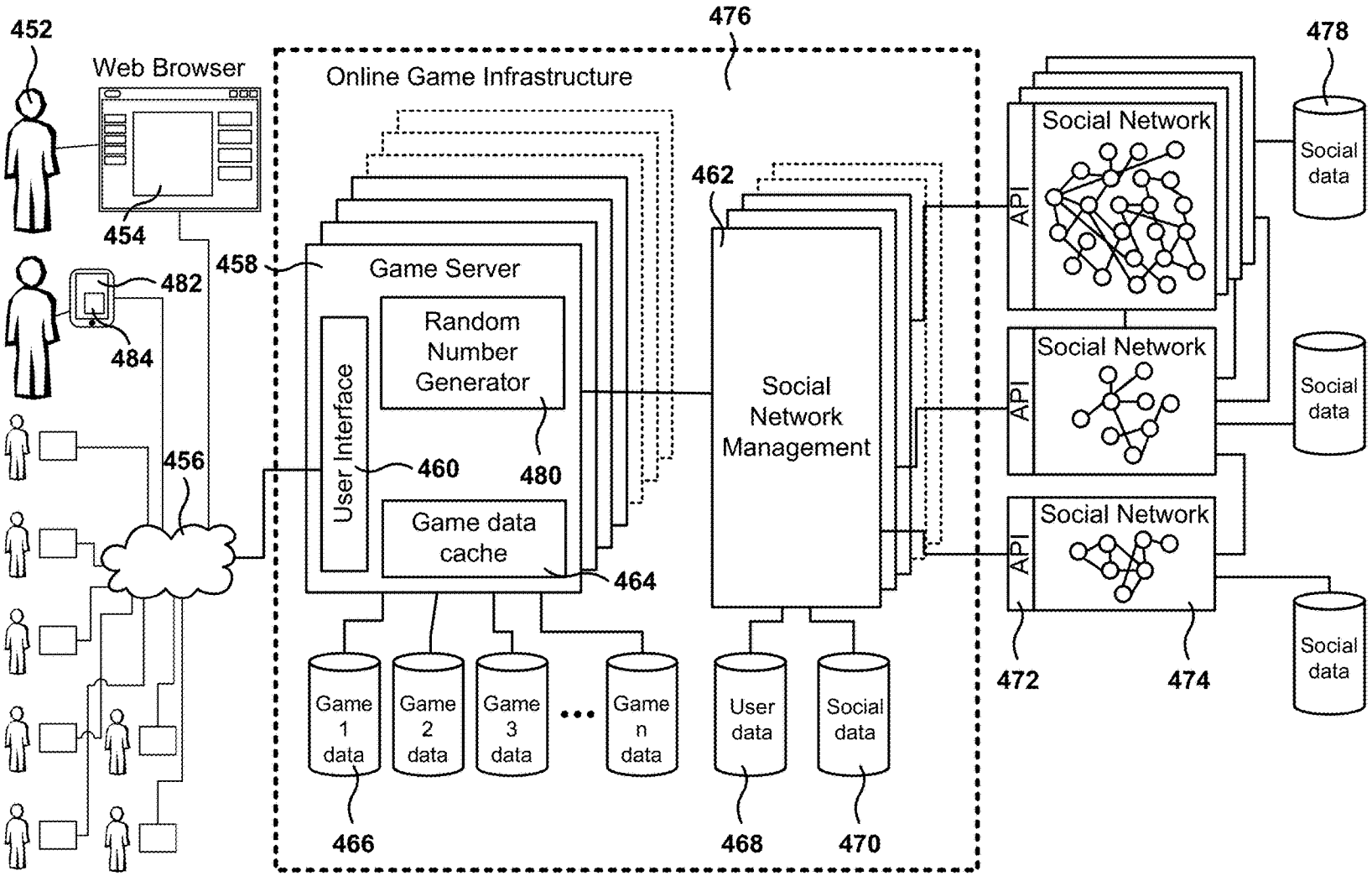
FIG. 8 illustrates an implementation of a Massively Multiplayer Online (MMO) infrastructure, according to one embodiment.

FIG. 8 illustrates an implementation of an online game infrastructure, according to one embodiment. The online game infrastructure 476 includes one or more game servers 458, web servers (not shown), one or more social network management servers 462, and databases to store game related information. In one embodiment, game server 458 provides a user interface 460 for players 452 to play the online game.

In one embodiment, game server 458 includes a Web server for players 452 to access the game via web browser 454, but the Web server may also be hosted in a server different from game server 458. Network 456 interconnects players 452 with the one or more game servers 458. In one embodiment, players access the game via a mobile device 482, or any other computing device, that includes a program application 484 installed in the mobile device 482 for playing the game. The program application 484 may be downloaded from a server as an app provided by the game provider. The program application 484 exchanges data with game server 458 for playing the game, and the game operations may be executed in game server 458, in mobile device 482, or in a combination of game server 458 and mobile device 482. In one embodiment, program application 484 exchanges information for synchronizing the game state at the game server 458. This enables the player to resume the game in a different device, such as in another portable device, or in a computer using web browser 454. Therefore, the game may be played in a plurality of different computing platforms.

In one embodiment, game server 458 analyzes the computing device being used to present interfaces to the player and adjusts interface data and game data to allow playing the game in a plurality of different platforms. For example, game server 458 may adjust the form factor of the interface that is provided to the user according to the device that the user is employing for entering game inputs.

Each game server 458 has access to one or more game databases 466 for keeping game data and random number generator 480. In addition, a single database can store game data for one or more online games. Each game server 458 may also include one or more levels of caching. Game data cache 464 is a game data cache for the game data stored in game databases 466. For increased performance, caching may be performed in several levels of caching. For instance, data more frequently used is stored in a high priority cache, while data requiring less access during a session will be cached and updated less frequently.

The number of game servers 458 changes over time, as the gaming platform is an extensible platform that changes the number of game servers according to the load on the gaming infrastructure. As a result, the number of game servers will be higher during peak playing times, and the number of game servers will be lower during off-peak hours. In one embodiment, the increase or decrease of bandwidth is executed automatically, based on current line usage or based on historical data.

One or more social network management servers 462 provide support for the social features incorporated into the online games. The social network management servers 462 access social data 478 from one or more social networks 474 via Application Programming Interfaces (API) 472 made available by the social network providers. An example of a social network is Facebook, but it is possible to have other embodiments implemented in other social networks. Each social network 474 includes social data 478, and this social data 478, or a fraction of the social data, is made available via API 472. As in the case of the game servers, the number of social network management servers 462 that are active at a point in time changes according to the load on the infrastructure. As the demand for social data increases, the number of social network management servers 462 increases. Social network management servers 462 cache user data in database 468, and social data in database 470. The social data may include the social networks where a player is present, the social relationships for the player, the frequency of interaction of the player with the social network and with other players, etc. Additionally, the user data kept in database 468 may include the player's name, demographics, e-mail, games played, frequency of access to the game infrastructure, etc.

It is noted that the embodiment illustrated in FIG. 8 is an exemplary online gaming infrastructure. Other embodiments may utilize different types of servers, databases, APIs, etc., and the functionality of several servers can be provided by a single server, or the functionality can be spread across a plurality of distributed servers. The embodiment illustrated in FIG. 8 should therefore not be interpreted to be exclusive or limiting, but rather exemplary or illustrative.

Figure 9:
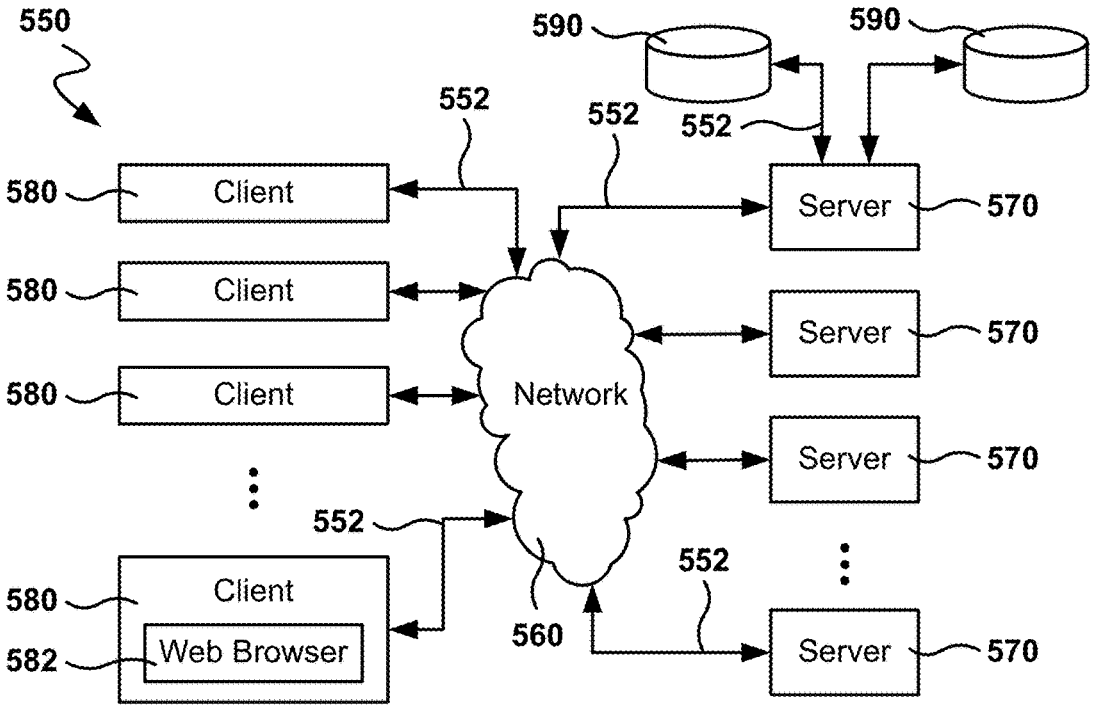
FIG. 9 illustrates an example network environment suitable for implementing embodiments.

FIG. 9 illustrates an example network environment 550 suitable for implementing embodiments. Network environment 550 includes a network 560 coupling one or more servers 570 and one or more clients 580 to each other. In particular embodiments, network 560 is an intranet, an extranet, a virtual private network (VPN), a local area network (LAN), a wireless LAN (WLAN), a wide area network (WAN), a metropolitan area network (MAN), a portion of the Internet, another network, or a combination of two or more such networks 560.

One or more links 552 couple a server 570 or a client 580 to network 560. In particular embodiments, one or more links 552 each includes one or more wired, wireless, or optical links 552. In particular embodiments, one or more links 552 each includes an intranet, an extranet, a VPN, a LAN, a WLAN, a WAN, a MAN, a portion of the Internet, or another link 552 or a combination of two or more such links 552.

Each server 570 may be a stand-alone server or may be a distributed server spanning multiple computers or multiple datacenters. Servers 570 may be of various types, such as, for example and without limitation, community server, web server, news server, mail server, message server, advertising server, file server, application server, exchange server, database server, or proxy server. Each server 570 may include hardware, software, embedded logic components, or a combination of two or more such components for carrying out the appropriate functionalities implemented or supported by server 570. For example, a web server is generally capable of hosting websites containing web pages or particular elements of web pages. More specifically, a web server may host HyperText Markup Language (HTML) files or other file types, or may dynamically create or constitute files upon a request, and communicate them to clients 580 in response to Hypertext Transfer Protocol (HTTP) or other requests from clients 580. A mail server is generally capable of providing electronic mail services to various clients 580. A database server is generally capable of providing an interface for managing data stored in one or more data stores.

In particular embodiments, one or more data storages 590 may be communicatively linked to one or more severs 570 via one or more links 552. Data storages 590 may be used to store various types of information. The information stored in data storages 590 may be organized according to specific data structures. In particular embodiments, each data storage 590 may be a relational database. Particular embodiments may provide interfaces that enable servers 570 or clients 580 to manage, e.g., retrieve, modify, add, or delete, the information stored in data storage 590.

In particular embodiments, each client 580 may be an electronic device including hardware, software, or embedded logic components or a combination of two or more such components and capable of carrying out the appropriate functionalities implemented or supported by client 580. For example and without limitation, a client 580 may be a desktop computer system, a notebook computer system, a notebook computer system, a handheld electronic device, or a mobile telephone. A client 580 may enable a network player at client 580 to access network 580. A client 580 may enable its player to communicate with other players at other clients 580. Further, each client 580 may be a computing device, such as a desktop computer or a work station, or a mobile device, such as a notebook computer, a network computer, or a smart telephone.

In particular embodiments, a client 580 may have a web browser 582, such as Microsoft Internet Explorer, Google Chrome, Or Mozilla Firefox, and may have one or more add-ons, plug-ins, or other extensions. A player at client 580 may enter a Uniform Resource Locator (URL) or other address directing the web browser 582 to a server 570, and the web browser 582 may generate a Hyper Text Transfer Protocol (HTTP) request and communicate the HTTP request to server 570. Server 570 may accept the HTTP request and communicate to client 580 one or more Hyper Text Markup Language (HTML) files responsive to the HTTP request. Client 580 may render a web page based on the HTML files from server 570 for presentation to the user. The present disclosure contemplates any suitable web page files. As an example and not by way of limitation, web pages may render from HTML files, Extensible Hyper Text Markup Language (XHTML) files, or Extensible Markup Language (XML) files, according to particular needs. Such pages may also execute scripts such as, for example and without limitation, those written in Javascript, Java, Microsoft Silverlight, combinations of markup language and scripts such as AJAX (Asynchronous Javascript and XML), and the like. Herein, reference to a web page encompasses one or more corresponding web page files (which a browser may use to render the web page) and vice versa, where appropriate.

Web browser 582 may be adapted for the type of client 580 where the web browser executes. For example, a web browser residing on a desktop computer may differ (e.g., in functionalities) from a web browser residing on a mobile device. A user of a social networking system may access the website via web browser 582.

Figure 10:
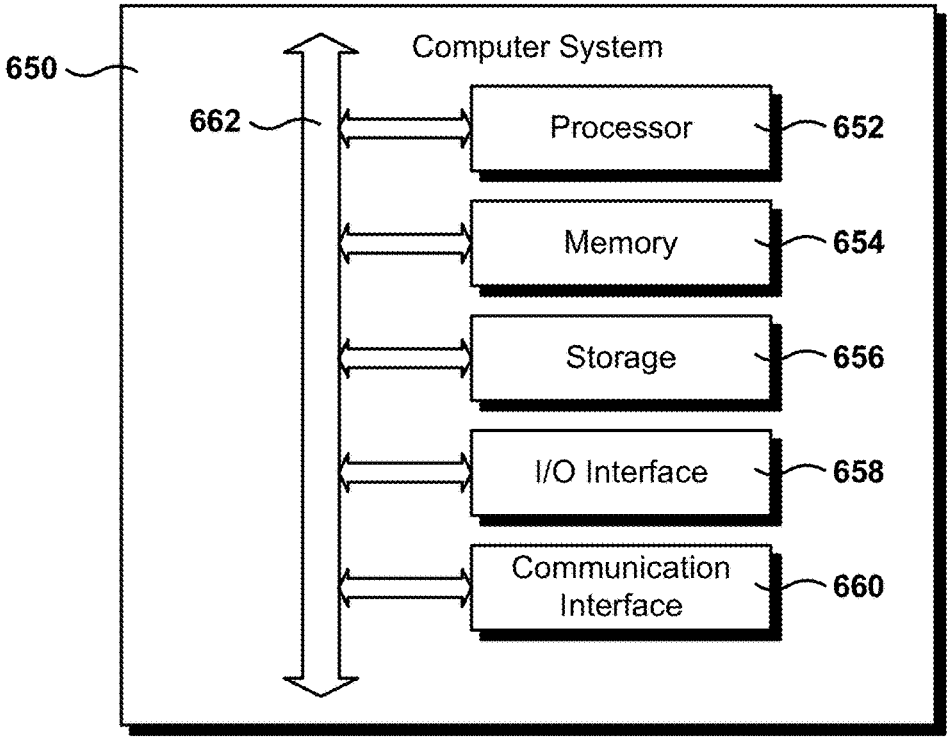
FIG. 10 illustrates an example computer system for implementing embodiments.

FIG. 10 illustrates an example computer system 650 for implementing embodiments. In particular embodiments, software running on one or more computer systems 650 performs one or more operations of one or more methods described or illustrated herein or provides functionality described or illustrated herein. Although methods for implementing embodiments were described with a particular sequence of operations, it is noted that the method operations may be performed in different order, or the timing for the execution of operations may be adjusted, or the operations may be performed in a distributed system by several entities, as long as the processing of the operations are performed in the desired way.

As example and not by way of limitation, computer system 650 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, or a combination of two or more of these. Where appropriate, computer system 650 may include one or more computer systems 650; be stand-alone or distributed; span multiple locations; span multiple machines; or reside in a cloud, which may include one or more cloud components in one or more networks. The one or more computer systems 650 may perform in real time or in batch mode one or more operations of one or more methods described or illustrated herein.

In particular embodiments, computer system 650 includes a processor 652, memory 654, storage 656, an input/output (I/O) interface 658, a communication interface 660, and a bus 662. Although this disclosure describes and illustrates a particular computer system having a particular number of particular components in a particular arrangement, embodiments may be implemented with any suitable computer system having any suitable number of any suitable components in any suitable arrangement.

In particular embodiments, processor 652 includes hardware for executing instructions, such as those making up a computer program. As an example and not by way of limitation, to execute instructions, processor 652 may retrieve (or fetch) the instructions from an internal register, an internal cache, memory 654, or storage 656; decode and execute them; and then write one or more results to an internal register, an internal cache, memory 654, or storage 656. The present disclosure contemplates processor 652 including any suitable number of any suitable internal registers, where appropriate. Where appropriate, processor 652 may include one or more arithmetic logic units (ALUs); be a multi-core processor; or include one or more processors 652. Although this disclosure describes and illustrates a particular processor, this disclosure contemplates any suitable processor.

In particular embodiments, memory 654 includes main memory for storing instructions for processor 652 to execute, or data that can be manipulated by processor 652. As an example and not by way of limitation, computer system 650 may load instructions from storage 656 or another source (such as, for example, another computer system 650) to memory 654. Processor 652 may then load the instructions from memory 654 to an internal register or internal cache. During or after execution of the instructions, processor 652 may write one or more results (which may be intermediate or final results) to the internal register or internal cache. Processor 652 may then write one or more of those results to memory 654. One or more memory buses (which may each include an address bus and a data bus) may couple processor 652 to memory 654. Bus 662 may include one or more memory buses, as described below. One or more memory management units (MMUs) reside between processor 652 and memory 654 and facilitate accesses to memory 654 requested by processor 652. Memory 654 includes random access memory (RAM).

As an example and not by way of limitation, storage 656 may include a Hard Disk Drive (HDD), a floppy disk drive, flash memory, an optical disc, a magneto-optical disc, magnetic tape, or a Universal Serial Bus (USB) drive or a combination of two or more of these. Storage 656 may include removable or non-removable (or fixed) media, where appropriate. In particular embodiments, storage 656 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these.

In particular embodiments, I/O interface 658 includes hardware, software, or both providing one or more interfaces for communication between computer system 650 and one or more I/O devices. One or more of these I/O devices may enable communication between a person and computer system 650. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these.

Communication interface 660 includes hardware, software, or both providing one or more interfaces for communication between computer system 650 and one or more other computer systems 650 on one or more networks. As an example and not by way of limitation, communication interface 660 may include a network interface controller (NIC) or network adapter for communicating with an Ethernet or other wire-based network or a wireless NIC (WNIC) or wireless adapter for communicating with a wireless network, such as a WI-FI network. As an example, computer system 650 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these.

In particular embodiments, bus 662 includes hardware, software, or both coupling components of computer system 650 to each other. As an example and not by way of limitation, bus 662 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or another suitable bus or a combination of two or more of these. Bus 662 may include one or more buses 662, where appropriate. Although this disclosure describes and illustrates a particular bus, this disclosure contemplates any suitable bus or interconnect.

Herein, reference to a computer-readable storage medium encompasses one or more non-transitory, tangible computer-readable storage media possessing structure that may store a computer program or data. As an example and not by way of limitation, a computer-readable storage medium may include a semiconductor-based or other integrated circuit (IC) (such, as for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a Secure Digital card, a Secure Digital drive, or another suitable computer-readable storage medium or a combination of two or more of these, where appropriate. Herein, reference to a computer-readable storage medium excludes any medium that is not eligible for patent protection under 35 U.S.C. § 101.

One or more embodiments can also be fabricated as computer readable code on a non-transitory computer readable medium. Herein, reference to software may encompass one or more applications, bytecode, one or more computer programs, one or more executables, one or more instructions, logic, machine code, one or more scripts, or source code, and vice versa, where appropriate.

The present disclosure encompasses all changes, substitutions, variations, alterations, and modifications to the example embodiments herein that a person having ordinary skill in the art would comprehend.

What is claimed is:

1. A method for online gaming executed by a gaming server, comprising:

receiving over a communication network at the gaming server from a first device user account information of a first player for playing a blackjack game, the gaming server including a database for storing game data of a plurality of online games including the blackjack game;

providing from the gaming server over the communication network first data for a sideboard interface to be presented by the first device before a current round of the blackjack game being played at a virtual table, the sideboard interface presenting multiple options for side bets, the side bets being wagers on one or more cards dealt during the current round of the blackjack game, wherein the side bets do not include wagers for the blackjack game, wherein the sideboard interface includes a matrix by card denomination and by suit for selecting a card denomination of a selected suit;

providing from the gaming server over the communication network second data for a blackjack interface to be presented by the first device for playing the blackjack game after one or more side bets have been entered by the first player in the sideboard interface, wherein the sideboard interface and the blackjack interface are presented one at a time by the first device;

checking at the gaming server if the one or more cards dealt during the current round of the blackjack game produce one or more winning side bets, wherein the one or more cards dealt is determined by a random number generator of the gaming server;

presenting notification of the one or more winning side bets in the blackjack interface during the current round of the blackjack game;

determining that the first player is on fire when playing the current round of the blackjack game;

providing digital benefits managed over the communication network using the database to friends of the first player when the first player is on fire based on gaming activity being tracked by the gaming server, wherein the friends are playing the current round of the blackjack game at the virtual table as executed by the gaming server or watching the current round being played at the virtual table as provided by the gaming server over the communication network, wherein the first player and the friends are part of a social network; and increasing at the gaming server a currency counter of the user account of the first player for the one or more winning side bets during the current round of the blackjack game, wherein operations of the method are executed by a processor.

2. The method as recited in claim 1, wherein each side bet is one or more of the selecting a card denomination and a selected suit for the card denomination, or selecting a first plurality of cards and the first player wins when all the cards from the first plurality of cards are dealt, or selecting a second plurality of cards and the first player wins when any of the cards from the second plurality of cards are dealt, or selecting a predetermined hand to be dealt to a dealer.

3. The method as recited in claim 1, wherein the sideboard interface further includes an option to select a group of cards, or selecting a dealer blackjack, or selecting a first player blackjack, or selecting any player blackjack.

4. The method as recited in claim 1, wherein the sideboard interface further includes information for payout for each possible side bet.

5. The method as recited in claim 1, wherein the current round of blackjack includes all the cards dealt to players while competing against one hand of a dealer and the cards dealt to the dealer for the one hand of the dealer.

6. The method as recited in claim 1, wherein the checking is performed on data received from the first device.

7. The method as recited in claim 1, wherein the one or more cards include all the cards dealt in the current round of blackjack.

8. The method as recited in claim 1, wherein the one or more cards include cards dealt to the player.

9. The method as recited in claim 1, wherein the one or more cards include a predetermined number of cards dealt during the current round of the blackjack game.

10. The method as recited in claim 1, wherein a winning side bet is produced when the one or more cards associated with one of the side bets are dealt in the current round of the blackjack game.

11. The method as recited in claim 1, wherein the blackjack interface includes a dealer, an option for betting in the current round of the blackjack game, an option for standing, an options for being hit, an option for splitting, and an option for doubling.

12. A method for online gaming executed by a gaming server, comprising:

receiving over a communication network at the gaming server from a first device user account information of a first player for playing a blackjack game, the gaming server including a database for storing game data of a plurality of online games including the blackjack game;

providing from the gaming server over the communication network first data for a sideboard interface to be presented by the first device before a current round of the blackjack game being played at a virtual table, the sideboard interface presenting multiple options for side bets, each side bet being a wager that a selected card denomination of a selected suit is dealt during the current round of the blackjack game to any player or to a dealer, wherein the sideboard interface includes a matrix by card denomination and by suit for selecting each side bet, wherein the sideboard interface and the blackjack interface are presented one at a time by the first device;

providing from the gaming server over the communication network second data for a blackjack interface to be presented by the first device for playing the blackjack game after one or more side bets have been entered by the first player in the sideboard interface;

checking at the gaming server if the one or more cards dealt during the current round of the blackjack game produce one or more winning side bets, wherein the one or more cards dealt is determined by a random number generator of the gaming server;

presenting notification of the one or more winning side bets in the blackjack interface during the current round of the blackjack game;

determining that the first player is on fire when playing the current round of the blackjack game;

providing digital benefits managed over the communication network using the database to friends of the first player when the first player is on fire based on gaming activity being tracked by the gaming server, wherein the friends are playing the current round of the blackjack game at the virtual table as executed by the gaming server or watching the current round being played at the virtual table as provided by the gaming server over the communication network, wherein the first player and the friends are part of a social network; and increasing at the gaming server a currency counter of the user account of the first player for the one or more winning side bets during the current round of the blackjack game, wherein operations of the method are executed by a processor.

13. The method as recited in claim 12, wherein presenting the blackjack interface further includes:

identifying cards associated with any side bet that are dealt during the current round of the blackjack game.

14. The method as recited in claim 12, wherein the sideboard interface further includes information for payout for each possible side bet.

15. The method as recited in claim 12, wherein the current round of blackjack includes all the cards dealt to a dealer for one hand of the dealer and all cards dealt to players for player hands that compete against the one hand of the dealer.

16. The method as recited in claim 12, wherein operations of the method are performed by a computer program when executed by one or more processors, the computer program being embedded in a non-transitory computer-readable storage medium.

17. A non-transitory computer-readable storage medium storing a computer program performing a method for online gaming executed by a gaming server, the computer-readable storage medium comprising:

program instructions for receiving over a communication network at the gaming server from a first device user account information of a first player for playing a blackjack game, the gaming server including a database for storing game data of a plurality of online games including the blackjack game;

program instructions for providing from the gaming server over the communication network first data for a sideboard interface to be presented by the first device before a current round of the blackjack game being played at a virtual table, the sideboard interface presenting multiple options for side bets, the side bets being wagers on one or more cards dealt during the current round of the blackjack game, wherein the side bets do not include wagers for the blackjack game, wherein the sideboard interface includes a matrix by card denomination and by suit for selecting a card denomination of a selected suit;

program instructions for providing from the gaming server over the communication network second data for a blackjack interface to be presented by the first device for playing the blackjack game after one or more side bets have been entered by the first player in the sideboard interface, wherein the sideboard interface and the blackjack interface are presented one at a time by the first device;

program instructions for checking at the gaming server if the one or more cards dealt during the current round of the blackjack game produce one or more winning side bets, wherein the one or more cards dealt is determined by a random number generator of the gaming server;

presenting notification of the one or more winning side bets in the blackjack interface during the current round of the blackjack game;

determining that the first player is on fire when playing the current round of the blackjack game;

providing digital benefits managed over the communication network using the database to friends of the first player when the first player is on fire based on gaming activity being tracked by the gaming server, wherein the friends are playing the current round of the blackjack game at the virtual table as executed by the gaming server or watching the current round being played at the virtual table as provided by the gaming server over the communication network, wherein the first player and the friends are part of a social network; and program instructions for increasing at the gaming server a currency counter of the user account of the first player for the one or more winning side bets during the round of the blackjack game.

18. The storage medium as recited in claim 17, wherein each side bet is one or more of the selecting a card denomination and a selected suit for the card denomination, or selecting a first plurality of cards and the first player wins when all the cards from the first plurality of cards are dealt, or selecting a second plurality of cards and the first player wins when any of the cards from the second plurality of cards are dealt, or selecting a predetermined hand to be dealt to a dealer.

* * * * *